US008150060B2

(12) United States Patent
Suzuki et al.

(10) Patent No.: US 8,150,060 B2
(45) Date of Patent: Apr. 3, 2012

(54) SURROUND SOUND OUTPUTTING DEVICE AND SURROUND SOUND OUTPUTTING METHOD

(75) Inventors: Koji Suzuki, Iwata (JP); Kunihiro Kumagai, Hamamatsu (JP); Susumu Takumai, Hamamatsu (JP)

(73) Assignee: Yamaha Corporation (JP)

( * ) Notice: Subject to any disclaimer, the term of this patent is extended or adjusted under 35 U.S.C. 154(b) by 508 days.

(21) Appl. No.: 12/392,694

(22) Filed: Feb. 25, 2009

(65) Prior Publication Data

US 2009/0214046 A1 Aug. 27, 2009

(30) Foreign Application Priority Data

Feb. 27, 2008 (JP) ..... 2008-046311

(51) Int. Cl.
*H04R 5/00* (2006.01)

(52) U.S. Cl. ..... 381/81; 381/1; 381/307

(58) Field of Classification Search ..... 381/1, 17–23, 381/307

See application file for complete search history.

(56) References Cited

U.S. PATENT DOCUMENTS

| | | | |
|---|---|---|---|
| 2006/0153391 | A1 | 7/2006 | Hooley et al. |
| 2008/0094524 | A1 | 4/2008 | Schobben |
| 2008/0165979 | A1 | 7/2008 | Takumai |
| 2009/0052700 | A1 | 2/2009 | Takumai |

FOREIGN PATENT DOCUMENTS

| | | | |
|---|---|---|---|
| EP | 1 760 920 | A1 | 3/2007 |
| EP | 1 865 751 | A1 | 12/2007 |
| JP | 2000-354300 | A | 12/2000 |
| JP | 2006-13711 | A | 1/2006 |
| JP | 2006-60610 | A | 3/2006 |
| JP | 2006-254103 | A | 9/2006 |
| JP | 2007-300404 | A | 11/2007 |
| WO | 2004/066673 | A1 | 8/2004 |
| WO | 2006/018747 | A1 | 2/2006 |
| WO | 2009/056858 | A2 | 5/2009 |

OTHER PUBLICATIONS

Notification of Reason for Refusal issued in corresponding Japanese Patent Application No. 2008-046311 dated Nov. 10, 2009. English translation only provided.

Extended European Search Report issued in corresponding European Patent Application No. 09002696.4 dated Dec. 14, 2010.

*Primary Examiner* — Hoai V Pham

(74) *Attorney, Agent, or Firm* — Rossi, Kimms & McDowell LLP

(57) ABSTRACT

A surround sound outputting device includes a receiving portion which receives signals on a plurality of channels, a storing portion which stores measuring sound data representing a sound, an outputting portion which outputs a sound produced based on the signals on the plurality of channels or the measuring sound data in a controlled direction and in a beam shape, a controlling portion which controls a direction of the sound output from the outputting portion, a sound collecting portion which picks up the sound output from the outputting portion to produce picked-up sound data representing the picked-up sound, an impulse response specifying portion which specifies impulse responses in respective directions from respective sound data, a path characteristic specifying portion which specifies path distances of the paths through which the sounds output in the respective directions arrive at the sound collecting portion from the outputting portion and levels of the impulse responses based on the impulse responses in the respective directions, and an allocating portion which specifies directions satisfying a predetermined relationship between the path distances of the paths in the respective directions and the levels of the impulse responses with respect to the plurality of channels respectively, and allocates the signals on the plurality of channels to the specified directions. The controlling portion controls the outputting portion so that respective sounds based on the signals on the plurality of channels are output in the directions specified by the allocating portion.

12 Claims, 6 Drawing Sheets

SURROUND SOUND OUTPUTTING DEVICE AND SURROUND SOUND OUTPUTTING METHOD

BACKGROUND

The present invention relates to a surround sound outputting device and a surround sound outputting method.

In the surround sound system, commonly a plurality of speakers are arranged around a listener, and sounds are provided to the listener with a sense of realism when the sounds on respective channels are output from respective speakers. In such case, since a plurality of speakers are arranged in the interior of a room, such problems arise that a space is needed, signal lines become a hindrance in the room, or the like.

As the technology to solve such problems, the speaker array devices mentioned hereunder have been proposed. That is, the sounds on respective channels are output from the speaker array device to have the directivity (as a beam) respectively, and are caused to reflect from left/right and rear wall surfaces of the listener, and the like. The sounds on respective channels arrive at the listener from reflected positions. As a result, the listener feels as if the speakers (sound sources) for outputting the sounds on respective channels are located in the reflecting positions. According to this speaker array device, the surround sound field can be produced not by providing a plurality of speakers but by providing a plurality of sound sources (virtual sound sources) in the space.

In Patent Literature 1, the technology to set the parameters concerning the shaping of the sounds on respective channels into the beam based on the user's input is disclosed. In the sound reproducing device disclosed in Patent Literature 1, emitting angles and path distances of the sound beams on respective channels are optimized based on the parameters (dimensions of the room in which the sound reproducing device is provided, a set-up position of the sound reproducing device, a listening position of the listener, etc.) input by the user.

Also, in Patent Literature 2, the technology to make fully automatically the above settings is disclosed. The sound beam is output from the main body of the speaker array device set forth in Patent Literature 2 while shifting an emitting angle respectively, and the sound beams are picked up by the microphone that is provided in the listener's position. Then, the emitting angles of the sound beams on respective channels are optimized based on the analyzed result of the sounds picked up at the emitting angles respectively.

[Patent Literature 1] JP-A-2006-60610

[Patent Literature 2] JP-A-2006-13711

In the technology disclosed in Patent Literature 1, such a problem existed that the optimization of parameters cannot be attained depending on the shape and the installing location of the room in which the voice reproducing device is installed. That is, various parameters must be input based on the premise that the listener listens the sound on the front side of the sound reproducing device installed in the room having a rectangular parallelepiped shape, and the like. In a situation that the room has an irregular shape, there is an impediment to user's listening, or the listener listens the sound in a position that gets out of the front of the sound reproducing device, or the like, the emitting angles of the sound beams on respective channels cannot be adequately calculated. Also, such a problem existed that the parameter setting becomes troublesome because the user must measure/input manually the dimensions of the room, positions of the voice reproducing device and the listener, and the like.

In the technology disclosed in Patent Literature 2, a sound pressure of the picked-up sounds is analyzed every emitting angle of the sound beam. In this case, it is not considered at all via what paths the sounds being output at respective emitting angles arrive at the microphone respectively. As a result, it is possible that the paths of the sound beams are estimated incorrectly and the emitting angles of the sounds on respective channels are set incorrectly.

SUMMARY

The present invention has been made in view of the above circumstances, and it is an object of the present invention to provide the technology to improve an accuracy of an emitting angle of an acoustic beam in contrast to the conventional method.

In order to achieve the above object, according to the present invention, there is provided a surround sound outputting device, comprising:

a receiving portion which receives signals on a plurality of channels;

a storing portion which stores measuring sound data representing a sound;

an outputting portion which outputs a sound produced based on the signals on the plurality of channels or the measuring sound data in a controlled direction and in a beam shape;

a controlling portion which controls a direction of the sound output from the outputting portion;

a sound collecting portion which picks up the sound output from the outputting portion to produce picked-up sound data representing the picked-up sound;

an impulse response specifying portion which specifies impulse responses in respective directions from respective sound data produced by the sound collecting portion when the sound collecting portion picks up the sounds output from the outputting portion in the respective directions;

a path characteristic specifying portion which specifies path distances of the paths through which the sounds output in the respective directions arrive at the sound collecting portion from the outputting portion and levels of the impulse responses based on the impulse responses in the respective directions; and an allocating portion which specifies directions satisfying a predetermined relationship between the path distances of the paths in the respective directions and the levels of the impulse responses with respect to the plurality of channels respectively, and allocates the signals on the plurality of channels to the specified directions, wherein the controlling portion controls the outputting portion so that respective sounds based on the signals on the plurality of channels are output in the directions specified by the allocating portion.

Preferably, the measuring sound data is sound data representing an impulse sound.

Preferably, the impulse response specifying portion specifies the impulse responses by calculating a cross correlation between the picked-up sound data and the measuring sound data. Here, it is preferable that the measuring sound data is sound data representing a white noise.

Preferably, the path characteristic specifying portion specifies the path distances based on leading timings in the impulse responses in the respective directions.

Preferably, the allocating portion allocates the signals of the plurality of channels to either of directions in which the levels of the impulse responses in the respective directions exceed a predetermined threshold value.

Preferably, the allocating portion allocates the signals of the plurality of channels to either of directions within predetermined angle ranges respectively containing directions in which the levels of the impulse responses in the respective directions exceed a predetermined threshold value.

Preferably, the allocating portion allocates the signals on the plurality of channels to either of the directions in which the levels of the impulse responses in the respective directions exceed a predetermined threshold value, path distances corresponding to the directions having the exceeded levels being limited within a predetermined distance range.

Preferably, the outputting portion is an array speaker having a plurality of speaker units. The controlling portion controls the direction of the sound output from the outputting portion by supplying sound data at a different timing every speaker unit.

According to the present invention, there is also provided a surround sound outputting method, comprising:

outputting a sound by an outputting portion in a controlled direction and in a beam shape, the sound produced being based on signals on a plurality of channels or measuring sound data representing a sound stored in a storing portion;

controlling a direction of the sound output from the outputting portion;

picking up the sound output from the outputting portion by a sound collecting portion to produce picked-up sound data representing the picked-up sound;

specifying impulse responses in respective directions from respective sound data produced by the sound collecting portion when the sound collecting portion picks up the sounds output from the outputting portion in the respective directions;

specifying path distances of the paths through which the sounds output in the respective directions arrive at the sound collecting portion from the outputting portion and levels of the impulse responses based on the impulse responses in the respective directions; and specifying directions satisfying a predetermined relationship between the path distances of the paths in the respective directions and the levels of the impulse responses with respect to the plurality of channels respectively, and allocates the signals on the plurality of channels to the specified directions, wherein the outputting portion outputs respective sounds based on the signals on the plurality of channels in the directions specified by the allocating portion.

According to the sound signal outputting device and the surround sound outputting method, an accuracy of the emitting angle of the acoustic beam can be improved in contrast to the conventional method.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS (A: Configuration)

A configuration of a speaker apparatus 1 according to an embodiment of the present invention will be explained hereunder.

(A-1: Appearance of the Speaker Apparatus 1)

Figure 1:
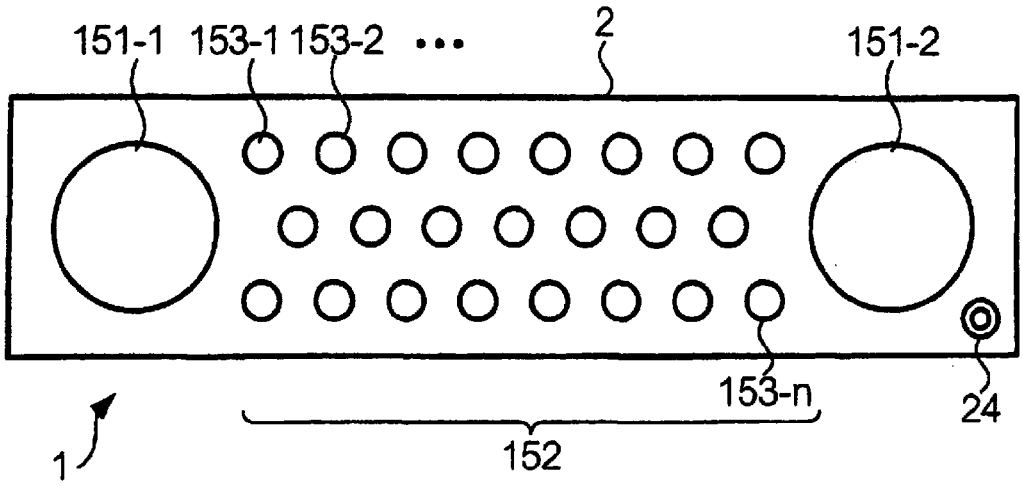
FIG. 1 is a view showing an appearance of a speaker apparatus 1.

FIG. 1 is a view showing an appearance (front) of the speaker apparatus 1. As shown in FIG. 1, a speaker array 152 is arranged in a center portion of an enclosure 2 of the speaker apparatus 1.

The speaker array 152 includes a plurality of speaker units 153-1, 153-2, . . . , **153-*n* (referred generically to as speaker units 153 hereinafter when it is not needed to distinguish them mutually). The speaker units 153** output the sounds in a high-frequency band (high-frequency components).

Also, a wafer 151-1 is provided on the left as the listener faces to the speaker apparatus 1 whereas a wafer 151-2 is provided on the right as the listener faces to the speaker apparatus 1 (referred generically to as wafers 151 hereinafter when it is not needed to distinguish them mutually). The wafers 151 output the sounds in a low-frequency band (low-frequency components).

Also, a microphone terminal 24 is provided to the speaker apparatus 1. A microphone can be connected to the microphone terminal 24, and the microphone terminal 24 receives a sound signal (analog electric signal).

(A-2: Internal Configuration of the Speaker Apparatus 1)

Figure 2:
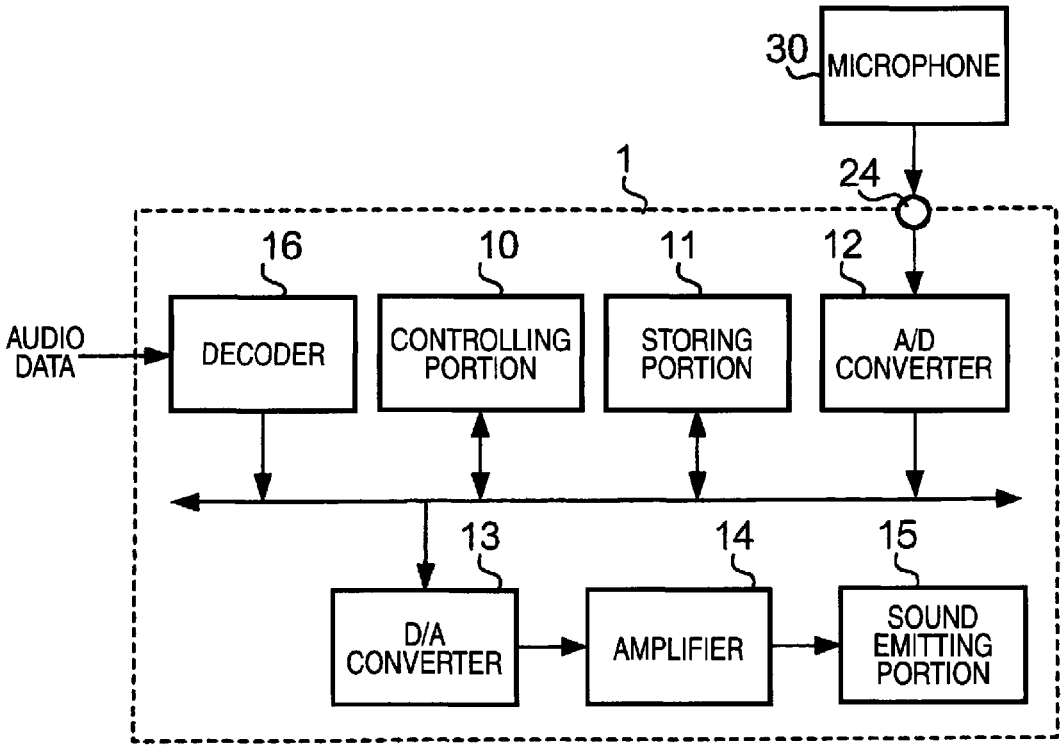
FIG. 2 is a block diagram showing a configuration of the speaker apparatus 1.

FIG. 2 is a diagram showing an internal configuration of the speaker apparatus 1.

A controlling portion 10 shown in FIG. 2 executes various processes in accordance with a control program stored in a storing portion 11. That is, the controlling portion 10 executes the processing of sound data on respective channels, described later, based on parameters being set. Also, the controlling portion 10 controls respective portions of the speaker apparatus 1 via a bus.

The storing portion 11 is a storing unit such as ROM (Read Only Memory), or the like, for example. A control program executed by the controlling portion 10, sound data for measuring, and music piece data are stored in the storing portion 11. The music piece data can be used as the sound data for measuring, but sound data representing a white noise is used herein. In this case, the white noise denotes a noise that contains all frequency components at the same intensity. Also, the music piece data gives music piece data for multichannel reproduction including plural (e.g., five) channels.

An A/D converter 12 receives the sound signals via the microphone terminal 24, and converts the received sound signals into digital sound data (sampling).

A D/A converter 13 receives the digital data (sound data), and converts the digital data into analog sound signals.

An amplifier 14 amplifies amplitudes of the analog sound signals.

A sound emitting portion 15 is composed of the above speaker array 152 and the wafers 151, and emits the sounds based on the received sound signals.

A decoder 16 receives audio data from an external audio data reproducing equipment connected via cable or radio, and converts the audio data into sound data.

In this case, a microphone 30 connected to the microphone terminal 24 is composed of a nondirectional microphone, and produces/outputs sound signals representing the picked-up sounds.

(A-3: Configuration Concerning the Sound Data Processing in Respective Channels)

The sounds on respective channels processed by the speaker apparatus 1 are processed separately in the high-frequency component and the low-frequency component.

Commonly it is not assumed in producing the contents that low-frequency components of the sounds on respective channels should be output to have the directivity respectively (surround sound reproduction). Also, it is assumed that the surround sound reproduction is not applied to the low-frequency components in the speaker apparatus 1. Therefore, explanation about a configuration for use in the process of the low-frequency component will be omitted herein.

In contrast, the surround sound reproduction is applied to the high-frequency components of the sounds on respective channels. A configuration for use in the process of the high-frequency component will be explained with reference to FIG. 3 hereunder.

Figure 3:
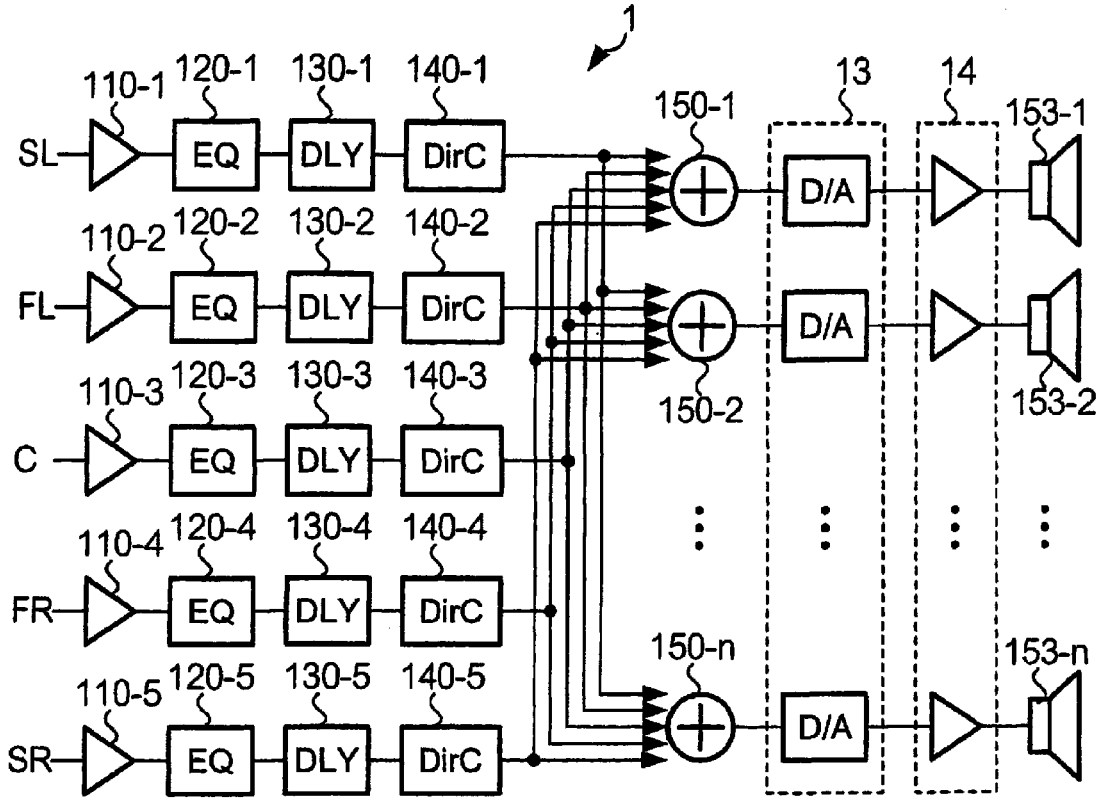
FIG. 3 is a block diagram showing a configuration concerning a high-frequency component process of the speaker apparatus 1.

As shown in FIG. 3, five-channel sound data (front left (FL)/right (FR), surround left (SL)/right (SR), and center (C)) contained in the audio data being input via the decoder 16 or the music piece data being read from the storing portion 11 are processed in the speaker apparatus 1.

Also, gain controlling portions 110-1 to 110-5 (referred generically to as gain controlling portions 110 hereinafter when it is not needed to distinguish them mutually) control a level of the sound data at a predetermined gain respectively.

In this case, a gain responding to a path distance of the sound on each channel is set in the gain controlling portions 110 respectively such that an attenuation generated until the sound on each channel arrives at the listener can be compensated. More specifically, a path distance from the speaker array 152 to the listener is extended in the surround channels (SL and SR) and thus the attenuation is increased. Therefore, a gain (sound volume) is set largely in the gain controlling portions 110-1 and 110-5. Also, a gain is set to almost a middle magnitude in the gain controlling portions 110-2, 110-4, and 110-3 to correspond to the front channels (FL and FR) and the center channel (C).

Also, frequency characteristic correcting portions (EQs) 120-1 to 120-5 (referred generically to as frequency characteristic correcting portions 120 hereinafter when it is not needed to distinguish them mutually) make a correction of the frequency characteristic respectively such that a change in frequency characteristic of the sound caused on the sound path on each channel is compensated. For example, the frequency characteristic correcting portions (EQs) 120-1, 120-2, 120-4, and 120-5 control the frequency characteristic respectively such that a change in frequency characteristic caused due to the reflection on the wall surface is compensated.

Also, delaying circuits (DLYs) 130-1 to 130-5 (referred generically to as delaying circuits 130 hereinafter when it is not needed to distinguish them mutually) control respective timings at which the sounds on respective channels arrive at the listener, by attaching a delay time to the sound on each channel respectively. More specifically, a delay time of the delaying circuits 130-1 and 130-5 corresponding to the surround channels (SL, SR) whose path distance is longest is set to 0, and a first delay time d1 that corresponds to a difference in the path distance from the surround channels is set in the delaying circuits 130-2 and 130-4 corresponding to the front channels (FL, FR). Also, a second delay time d2 (d2>d1) that corresponds to a difference in the path distance from the surround channels is set in the delaying circuit 130-3 corresponding to the center channel (C).

Also, directivity controlling portions (DirCs) 140-1 to 140-5 (referred generically to as directivity controlling portions 140 hereinafter when it is not needed to distinguish them mutually) apply following processes to the sound data being input from the corresponding delaying circuits 130 respectively, and output different sound data to a plurality of superposing portions 150-1 to **150-*n* (referred generically to as superposing portions 150 hereinafter when it is not needed to distinguish them mutually) provided to correspond to the speaker units 153** respectively.

A delay circuit and a level controlling circuit are provided to the directivity controlling portions 140 respectively to correlate with n-speaker units 153 constituting the speaker array 152. The delay circuits delay the sound data to be fed to respective superposing portions 150 (in turn, respective speaker units 153) by a predetermined time respectively. The delay time is set to the delay circuits respectively such that the sound data as the processed object is shaped into a beam in a predetermined direction. Also, the level controlling circuit multiplies the sound data on respective channels by a window factor respectively. According to this process, such a control is applied that side lobes of the sounds being input from the speaker array 152 should be suppressed.

The superposing portions 150 receive the sound data from the directivity controlling portions 140 and add them. The added sound data is output to the D/A converter 13.

The gain controlling portions 110, the frequency characteristic correcting portions 120, the delaying circuits 130, the directivity controlling portions 140, and the superposing portions 150, mentioned as above, are functions that are implemented respectively when the controlling portion 10 executes the control program stored in the storing portion 11.

The D/A converter 13 converts the sound data received from the superposing portions 150-1 to **150-*n* into the analog signals, and outputs the analog signals to the amplifier 14**.

The amplifier 14 amplifies the received signals, and outputs the amplified signals to the speaker units 153-1 to **153-*n* that are provided to correspond to the superposing portions 150-1 to 150-*n***.

The speaker units 153 are composed of a nondirectional speaker respectively, and emit the sounds based on the received signals.

(B: Operation)

In the following, prior to the explanation of the operation of the speaker apparatus 1 according to the present invention, a surround sound field produced by the speaker apparatus 1 will be explained simply.

(B-1: Surround Sound Field)

Figure 4:
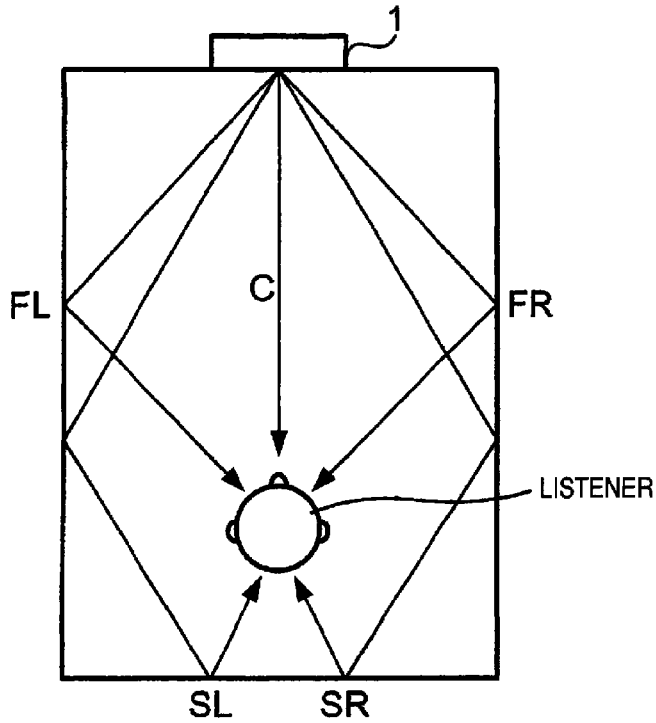
FIG. 4 is a view showing a surround sound field produced by the speaker apparatus 1.

FIG. 4 is a view showing schematically paths of the sounds on respective channels in a space in which the speaker apparatus 1 is installed. The sharp directivity is given to the sounds on respective channels, and these sounds are output from the speaker array 152 at the emitting angles that are set to the channels respectively. The sounds on the front channels (FL and FR) reflect once on the side surface beside the listener, and then arrive at the listener. Also, the sounds on the surround sound channels (SL and SR) reflect once on the side surface and the rear surface around the listener respectively, and then arrive at the listener. Also, the sound on the center channel (C) is output to the front side of the speaker apparatus 1. As a result, the sounds on respective channels arrive at the listener from the different directions respectively, and thus the listener feels as if the sound sources of respective channels (virtual sound sources) reside in the directions in which the sounds on respective channels arrive at.

In this manner, because the sounds on respective channels arrive at the listener while going along the different path mutually, a different effect is given to the sounds that arrive at the listener on respective channels every following path. For example, because the path distance is different every path, such an effect is brought about that either an extent of attenuation of the sound volume level of the sound on each channel is different or an arriving time is shifted. Alternately, because the number of times of the reflection on the wall surface or the reflecting characteristic of the wall surface is different every path, such an effect is brought about that a changing mode of the frequency characteristic is different channel by channel. In the speaker apparatus 1, differences in the attenuation of the sound volume level/the deviation in the arriving time/the frequency characteristic between the channels can be corrected by executing the data processing every channel.

The process of applying a predetermined process to the sounds on respective channels to output the sounds as a beam, as described above, is called a "beam control". The preferable surround sound field can be accomplished when the parameters regarding the beam control are set appropriately.

In the speaker apparatus 1, various parameters are optimized by an automatic optimizing process that will be explained hereunder.

(B-2: Automatic Optimizing Process)

Figure 5:
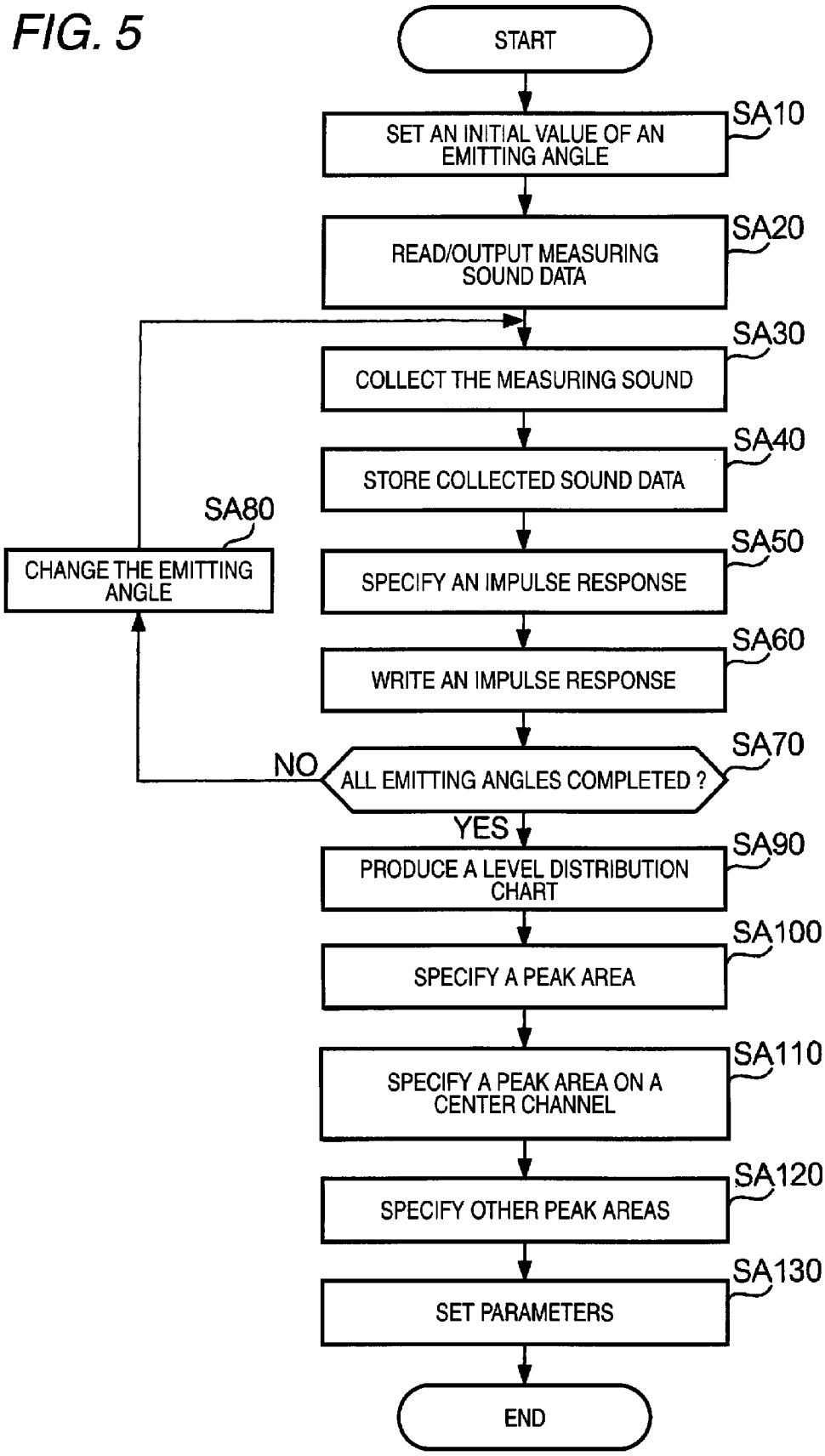
FIG. 5 is a flowchart showing a flow of an automatic optimizing process.

After the speaker apparatus 1 is installed, first an "automatic optimizing process" is started. The automatic optimizing process gives a process to automatically set the parameters concerning the beam control of the sounds on respective channels. FIG. 5 is a flowchart showing a flow of the automatic optimizing process.

Prior to the automatic optimizing process, the microphone 30 is connected to the microphone terminal 24 of the speaker apparatus 1. Then, the microphone 30 is set up in the position where the listener listens the sounds (see FIG. 4). At this time, ideally the microphone 30 should be set up at the same height as the listener's ears.

In step SA10, an initial value of an angle (emitting angle) at which the sound having a beam shape is output is set. In the following, explanation will be made under the assumption that, when viewed from the side of the speaker apparatus 1, the emitting angle in the front direction of the speaker apparatus 1 is set as a reference (0°) and the emitting angle has a positive value toward the left side of the reference. In the present embodiment, −80° (the rightward direction), or the like is set an initial value of the emitting angle.

In step SA20, the measuring sound data is read from the storing portion 11, and the white noise is output based on the measuring sound data. The white noise has the sharp directivity at the emitting angle that is set to the speaker apparatus 1 at that time, and then is output as the acoustic beam.

In step SA30, the sounds (containing the white noise) in the space are picked up by the microphone 30, and the sound signals representing the picked-up sounds are supplied to the speaker apparatus 1 via the microphone terminal 24.

In step SA40, the sound signals supplied to the speaker apparatus 1 are A/D converted by the A/D converter 12, and then stored in the storing portion 11 as "picked-up data". The contents of the picked-up data at respective instants contain a plurality of sound components that arrive at the microphone 30 via various paths. In this case, respective sound components indicate the sounds that were output from the speaker array 152 predetermined times being obtained by dividing the path distances, along which respective sound components come, by the velocity of sound ago. The characteristics (the sound volume level and the frequency characteristic) are changed depending on respective paths.

In step SA50, an impulse response is specified based on the picked-up data. In the present embodiment, the impulse response is specified by the method that is commonly called a "direct correlation method". In brief, the impulse response is specified based on the fact that a "cross correlation function" between the input data (the measuring sound data) and the output data (the data obtained by applying various delay times to the picked-up data generated in response to the output of the measuring sound data) becomes equal to the data in which an autocorrelation function of the input data (the measuring sound data) and the impulse response are convoluted mutually.

According to the direct correlation method, even when the noises (the background noise, etc.) picked up by the microphone 30 are contained in the picked-up data, the impulse response can be calculated without the influence of the noise. This is because no correlation is present between the input measuring sound data and the noise and therefore the factors derived from the noise are canceled upon calculating the impulse response.

Figure 6:
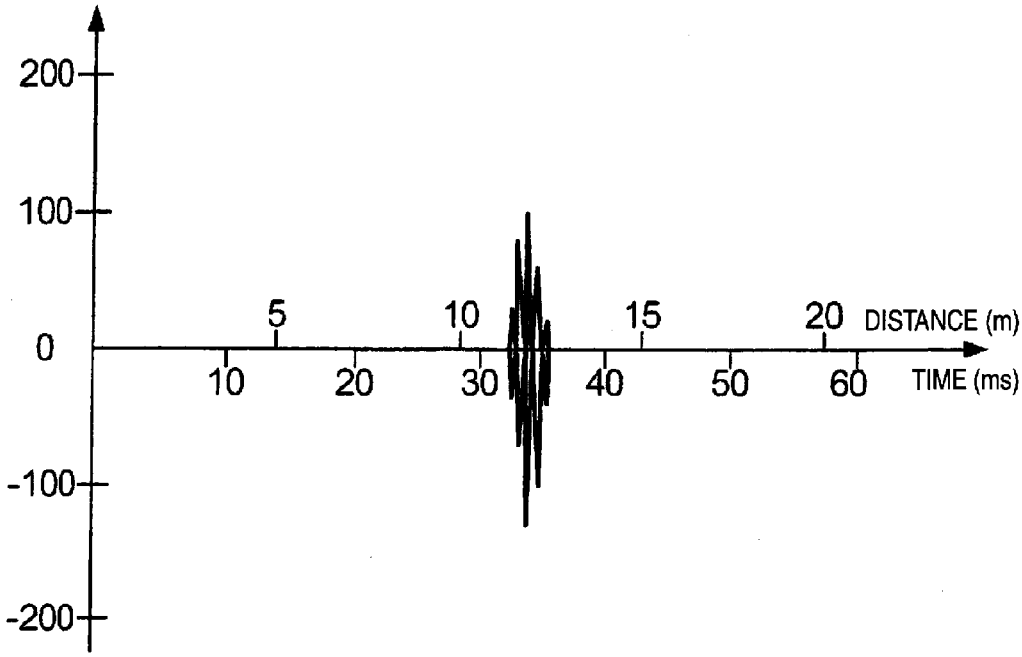
FIG. 6 is a graph showing an example of an impulse response (whose emitting angle is 40°)

When an instant at which the acoustic beam is output is assumed as a time 0, the impulse response specified in this manner gives a distribution of the sound volume level at respective times when respective sound components contained in the acoustic beam arrive at the microphone 30. FIG. 6 is a graph showing the impulse response that was obtained by such method when the emitting angle is 40°.

In the data of the impulse response shown in FIG. 6, a peak of the response appeared in the position of about 34 ms. Therefore, it was found that the acoustic beam being output from the speaker apparatus 1 arrives at the microphone 30 after about 34 ms and then is picked up by the microphone 30.

Also, the path distance along which the acoustic beam goes can be estimated from the data of the impulse response. For example, when it is assumed that the sound propagates through the space at the velocity of sound of 340 m/s, it can be estimated that the sound components that arrived at the microphone 30 after 34 ms follow the path distance of $340\times 0.034\approx 12$ m. Therefore, a time axis on the abscissa can be grasped as the path distance in the impulse response shown in FIG. 6.

Also, the level of the peak of impulse response indicates efficiency in collecting the output sound. In other words, the higher level of the peak indicates that the output white noise arrived effectively at the microphone 30 not so undergo an attenuation of the sound volume level, a change of the sound, and the like. As a result, for example, when the microphone 30 is set up in the direction of the emitting angle of the acoustic beam, when the microphone 30 is set up in the course of the reflection path of the acoustic beam, when the number of times of reflection on the wall surface, or the like is few in the path required until the sound arrives at the microphone 30, or the like, the level of the peak of impulse response is enhanced.

In step SA60, the specified impulse response is written into the storing portion 11. Here, only the path distance (i.e., time) in a predetermined range (e.g., 0 to 20 m) out of the data of the impulse response at this time is written into the storing portion 11. The reason why is that the path that exceeds 20 m, for example, is the inadequate path as the path of the sound on each channel, and thus is not used in the following processes.

In step SA70, it is decided whether or not the impulse response has specified at all emitting angles. First, in step SA10, the emitting angle is set to an initial value of −80° (the rightward direction), and the impulse response is specified. Then, the similar process is repeated while changing the emitting angle sequentially by a predetermined angle (e.g., +2°), and thus the impulse responses are specified at respective emitting angles. This process is repeated up to the emitting angle θ=+80°, or the like.

Therefore, at the present stage that the impulse response is specified when the emitting angle is −80°, the decision result in step SA70 is "No". Then, the process in step SA80 is executed.

In step SA80, a change of the emitting angle is made. That is, the emitting angle being set at that time point is changed by +2°. Therefore, the emitting angle becomes −78°.

The processes in step SA30 to step SA80, i.e. the processes in which the emitting angle is changed and also the impulse response at that emitting angle is specified are repeated. When the impulse response at the emitting angle of +80° is specified finally, the decision result in step SA70 becomes "Yes". Then, the processes subsequent to step SA90 are executed.

In step SA90, the data of the impulse response at respective emitting angles are read from the storing portion 11, and a level distribution chart is produced. First, square values of the response values of the path distances (times) in the data of the impulse response are calculated, and then an envelope (enveloping line) of the square values is produced. Then, the envelope produced at respective emitting angles are correlated with the emitting angles in the level distribution chart. As a result, the envelope based upon the impulse response is three-dimensionally correlated with the emitting angle (abscissa) and the path distance (ordinate) in the level distribution chart.

Figure 7:
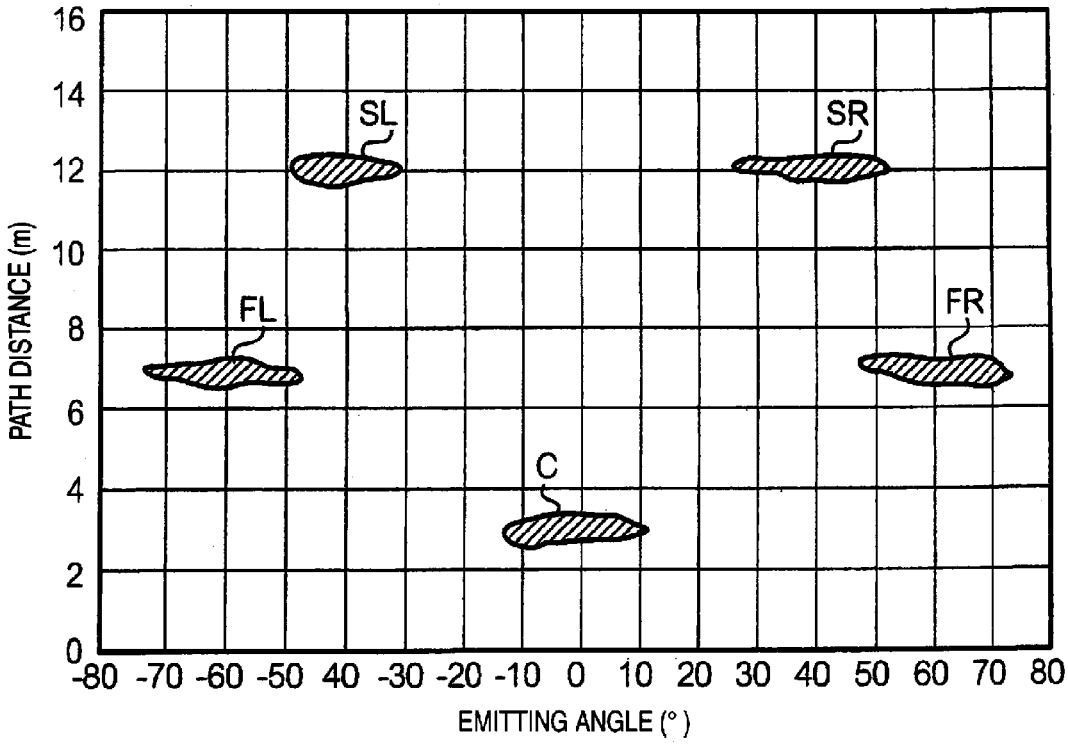
FIG. 7 is a block diagram showing an example of a level distribution chart.

In step SA100, areas in which the value of the envelope exceeds a predetermined threshold value (peak areas), i.e., combinations of the emitting angle and the path distance are specified from the level distribution chart. The peak areas are indicated with the hatch lines in a level distribution chart shown in FIG. 7. For example, according to the result of the impulse response (the emitting angle is 40°) shown in FIG. 6, the peaks of the response value appear in the position that corresponds to the path distance 12 m. In the level distribution chart shown in FIG. 7, the peak area is present in the position of the path distance 12 m and the emitting angle 40° so as to correspond to this result.

Then, the peak areas corresponding to the sound data on five channels are specified from the peak areas contained in the level distribution chart. A method of specifying the peak areas corresponding to the sound data on five channels from respective peak areas will be explained hereunder.

In step SA110, first the peak area corresponding to the center channel (referred to as a "center channel peak area" hereinafter) is specified. The center channel peak area is specified as the peak area in which the response value shows the peak in a predetermined angle range (e.g., −20° to +20°). For example, in the level distribution chart shown in FIG. 7, the peak area located at the emitting angle 0° and the path distance 3 m is specified as the center channel peak area.

The emitting angle and the path distance corresponding to the specified center channel peak area are written in the storing portion 11.

In step SA120, the peak areas corresponding to other channels are specified based on the center channel peak area as follows.

Respective peak areas contained in the level distribution chart are classified into three following groups, from the relationship between the emitting angle and the path distance to which the peak area corresponds.

(1) front channel peak area (2) surround channel peak area (3) irregular reflection peak area Respective peak areas contained in the level distribution chart are classified into above three groups (1) to (3) in accordance with the algorithm described hereunder. First, a "criterion value D" used as a reference of the classification is calculated with respect to respective peak values as follows. In this case, in Formula 1, L denotes the path distance on the center channel specified in step SA110, and θ denotes the emitting angle corresponding to each peak area.

$$D=L/\cos\theta \qquad \text{[Formula 1]}$$

Then, the path distance corresponding to the peak area is compared with the criterion value D calculated as above in respective areas. As the result of comparison, when the path distance corresponding to the peak area coincides substantially with the criterion value D calculated for this peak area (when a difference is below a predetermined threshold value), this peak area is decided as the front channel peak area (1). Also, when the path distance corresponding to the peak area is larger than the criterion value D calculated for this peak area and a difference is in excess of the predetermined threshold value, this peak area is decided as the surround channel peak area (2). Also, when the path distance corresponding to the peak area is smaller than the criterion value D calculated for this peak area and a difference is in excess of the predetermined threshold value, this peak area is decided as the irregular reflection peak area (3).

The reasons why respective peak areas contained in the level distribution chart and respective channels can be correlated mutually by the above algorithm are given as follows.

Figure 8:
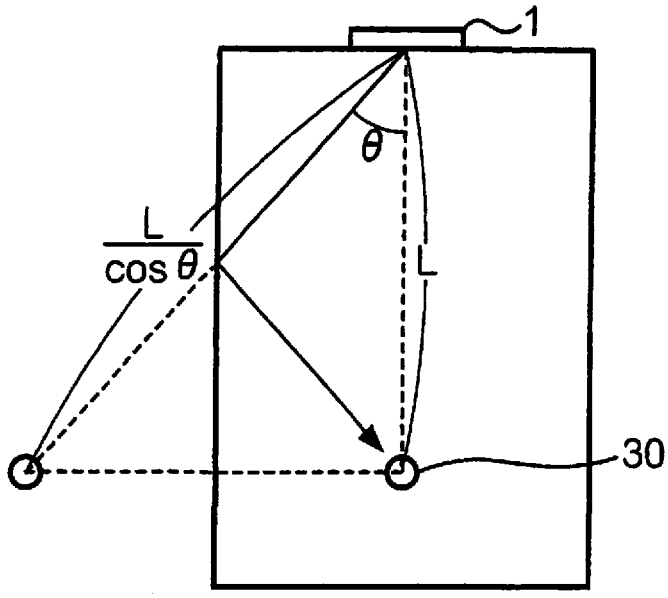
FIG. 8 is a view showing a path of a sound on the front channel.

FIG. 8 is a view showing the path of the sound in the space in which the speaker apparatus 1 is installed. In FIG. 8, the path distance of the center channel is indicated with L. Here, the path of the sound of the front channel in the path from the speaker apparatus 1 to the microphone 30 is indicated with a solid line in FIG. 8. The path distance of this path is represented geometrically by L/cos θ (=criterion value D). Therefore, when the fact that "the path distance corresponding to the peak area is substantially equal to the criterion value D calculated for this peak area" is used as the criterion in specifying the front channel peak area, the front channel peak area is specified adequately.

Figure 9:
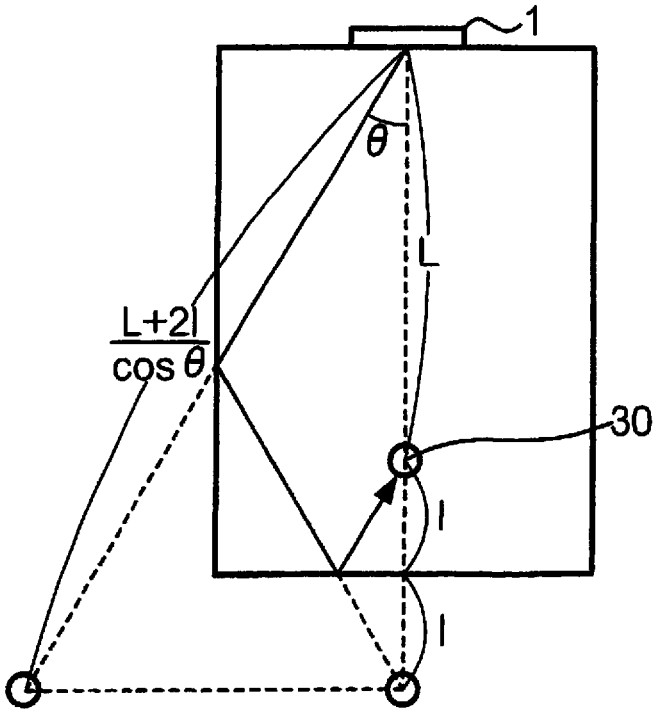
FIG. 9 is a view showing a path of a sound on the surround sound channel.

Also, in FIG. 9 showing the path of the sound in the space similarly to FIG. 8, the path of the sound on the surround sound channel is indicated with a solid line. The path distance of this path is represented geometrically by (L+2×l)/cos θ=D+(2×l/cos θ). In this manner, the path distance of the sound on the surround sound channel has the value larger than the criterion value D. Therefore, when the fact that "the path distance corresponding to the peak area is larger than the criterion value D calculated for this peak area" is used as the criterion in specifying the surround channel peak area, the surround channel peak area is specified adequately.

Figure 10:
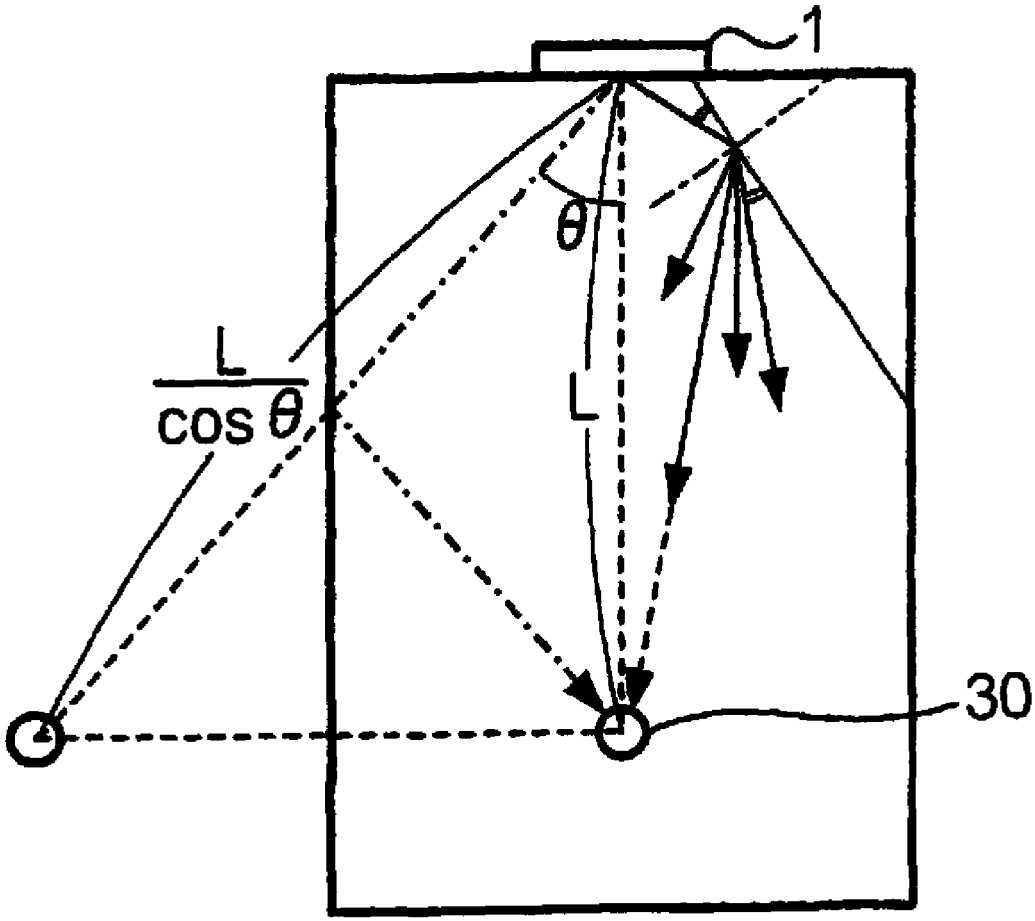
FIG. 10 is a view showing a path of an irregular reflection sound.

Also, the sound components that are generated in the speaker apparatus 1 and propagate in the different direction from the controlled directivity (irregular reflection sounds) arrive at the microphone 30. The sound components of such irregular reflection sounds, which arrive directly at the microphone 30 from the speaker apparatus 1, are sometimes detected as the peak area in the level distribution chart. The path distance in such peak area become L that is substantially equal to the path distance of the sound of the center channel, and has a value that is smaller than the criterion value D (see FIG. 10). Therefore, when the fact that "the path distance corresponding to the peak area is smaller than the criterion value D" is used as the criterion in specifying the irregular reflection peak area, the irregular reflection peak area is specified adequately.

In step SA130, various parameters for use in the beam control of the sounds on respective channels are set to respective portions of the speaker apparatus 1. In other words, the peak areas corresponding to respective channels are specified in the level distribution chart, and the emitting angles and the path distances corresponding to the peak areas are set as the emitting angles and the path distances for use in the beam control of the sounds on respective channels.

In the following, a method of setting the parameters concerning the beam control will be explained concretely while taking the surround right (SR) channel as an example. Similarly, the parameters are set to other channels based on the emitting angles and the path distances corresponding to the specified peak areas respectively.

First, in respective portions of the speaker apparatus 1 shown in FIG. 3, a gain decided based on the path distance of the SR channel is set to the gain controlling portion 110-5 that executes a process of sound data of the SR channel. Because the path distance of the SR channel is relatively long like 12 m, a relatively high gain is set to the gain controlling portion 110-5.

Then, 0 second is set to the delaying circuit 130-5 that processes the sound data on the SR channel as a delay time. In this case, the delay times are set to the delaying circuits 130-1 to 130-4, which are concerned with the processes on other channels, based on differences between the path distances of the sounds on respective channels, which are processed by respective delaying circuits 130, and the path distance of the sound on the SR channel. For example, since the path distance of the front right (FR) channel is 7 m and is shorter than the path distance (12 m) of the SR channel by 5 m, a delay time of about 15 ms required of the sound to go ahead by 5 m is set to the delaying circuit 130-5.

As the emitting angle of the sound on the SR channel, 40° is set to the directivity controlling portion 140-5 that processes the sound data on the SR channel. That is, different delays are given to the sound data, which are to be output to respective superposing portions 150, in a plurality of delaying circuits provided to the directivity controlling portion 140-5 respectively. As a result, the sound on the SR channel is shaped into the beam in the direction at the emitting angle 40°.

With the above, the automatic optimizing process is completed. As shown in FIG. 4, the sounds on respective channels arrive at the listener via the different path respectively. Therefore, various characteristics of the sounds such as an attenuation of a sound volume level and a time delay depending upon the path distance of the path that is required to arrive at the listener, an attenuation of a sound and a change in the frequency characteristic depending upon the number of times of reflection on the path and the material of the reflection surface, and others are different every channel. For this reason, the parameters concerning the gain, the frequency characteristic, and the delay time are set every channel, and consonance of sounds can be achieved among the sound data on respective channels. Also, the parameters concerning the directivity control are set such that the sounds on respective channels are output at the optimum emitting angle and then arrive at the listener at the optimum angle. In the initial setting process, various parameters are set to get the optimum surround sound reproduction, as described above.

(B-3: Surround Sound Reproduction)

In the following, a mode of the surround sound reproduction at the stage that various parameters are optimized by the automatic optimizing process will be explained briefly.

As shown in FIG. 3, the sound data on five channels (FL, FR, SL, SR, and C) contained in the audio data being input via the decoder 16 or the music piece data being read from the storing portion 11 are read. Then, corrections are made by the gain controlling portions 110, the frequency characteristic correcting portions 120, and the delaying circuits 130 being provided to respective channel systems such that the sound volume level, the frequency characteristic, and the delay time are well matched between the channels.

The directivity controlling portion 140 applies the process to the sound data on respective channels supplied to the speaker units 153 in a different mode (a gain and a delay time) respectively. The sounds on respective channels being output from the speaker array 152 are shaped into the beam in the particular direction. The sounds on respective channels being shaped into the beam follow respective paths as shown in FIG. 4, and arrive at the listener from different directions respectively. Various parameters concerning these sound data processes are optimized in all channels by the automatic optimizing process, so that the listener can enjoy the optimized surround sound field.

(C: Variations)

An embodiment of the present invention is explained as above. But the present invention is not restricted to the above embodiment, and various other embodiments can be applied. Examples will be illustrated hereunder by way of example. In this case, respective embodiments explained hereunder may be carried out appropriately in combination.

(1) In the above embodiment, the case where the white noise is used as the sound of the measuring sound data is explained. In this case, the sound of the measuring sound data is not limited to the white noise, and another sound such as a sound represented by a TSP (Time Stretched Pulse) signal may be employed. Here, the TSP signal means a signal obtained by stretching the impulse on a time axis.

(2) In the above embodiment, the case where the impulse responses at respective emitting angles are specified by the direct correlation method is explained. In this case, the method of specifying the impulse response is not limited to the direct correlation method.

(a) Collection of the Impulse Sound

When the impulse sound (very short sound) is used the measuring sound data and then this sound is picked up by the microphone 30, the impulse response can be measured directly.

(b) Cross Spectrum Method

When the white noise is used as the measuring sound data like the above embodiment, then a quotient of the Fourier-transformed autocorrelation function of the measuring sound data and the Fourier-transformed cross correlation between the measuring sound data and the picked-up sound data is calculated, and then an inverse Fourier transform is applied to the quotient, the impulse response can be calculated. The cross spectrum method is similar to the direct correlation method in the above embodiment.

(3) In the above embodiment, an example of the algorithm applied to classify respective peak areas into the groups in the level distribution chart is explained. In addition to the above conditions or instead of the above conditions, respective peak areas may be classified in the conditions described hereunder.

(a) Respective peak areas in the level distribution chart may be classified based on the emitting angles that are correlated with respective peak areas. For example, the front channel peak areas may be specified in the condition that these areas are present within a predetermined angle range (e.g., 14° to 60°) of the emitting angle of the center channel peak area. Also, the surround channel peak areas may be specified in the condition that these areas are present within a predetermined angle range (e.g., 25° to 84°) of the emitting angle of the center channel peak area.

(b) Respective peak areas in the level distribution chart may be classified by referring to the detected sound volume level. For example, the peak areas on the front channels may be specified in the condition that the sound volume level of the picked-up sound data corresponding to the peak areas is more than −15 dB. In this case, since the sound on the surround channel reflects twice on the wall surface and then arrives at the microphone 30, the condition of the sound volume level may not be provided in specifying the peak areas on the surround channels, and others.

(4) In the above embodiment, the effect that the classification is made based on the condition that the path distances of respective peak areas and the criterion value D satisfy a predetermined relationship is explained. In such a situation that the peak area is specified in plural under the above conditions, or the like, the peak area may be specified further in the following conditions.

(a) When (the emitting angle in the center channel peak area)−14°<the emitting angle in the peak area<(the emitting angle in the center channel peak area)+14°, it may be decided that this peak area does not belong to any area. This is because, when a difference is hardly present between the center channel and the emitting angle, it may be considered that this peak area does not correspond to other channels except the center channel.

(b) When the criterion value D/1.4≦the path distance in the peak area≦the criterion value D×1.3, this peak area may be specified as the front channel peak area. That is, when such numerical relationship is satisfied, "the path distance corresponding to this peak area coincides roughly with the criterion value D" may be decided. In this case, when any one of the conditions given in the following is satisfied even though the above inequality is satisfied, it may be decided that this peak area is not the front channel peak area.

84<an absolute value of the emitting angle of the peak area the absolute value of the emitting angle of the peak area<25 the sound volume level in the peak area<−15 dB (c) When the criterion value D×1.3<the path distance in the peak area, this peak area may be specified as the peak area of the surround channel. That is, when such numerical relationship is satisfied, "the path distance corresponding to the peak area is larger than the criterion value D and a difference is in excess of the predetermined threshold value" may be decided. In this case, when a following condition is satisfied even though the above inequality is satisfied, it may be decided that this peak area is not the surround channel peak area.

60<absolute value of the emitting angle of the peak area (d) When the path distance in the peak area<the criterion value D/1.4, this peak area may be specified as the irregular reflection peak area. That is, when such numerical relationship is satisfied, "the path distance corresponding to the peak area is smaller than the criterion value D and a difference is in excess of the predetermined threshold value" may be decided. In this case, when any one of the conditions given in the following is satisfied even though the above inequality is satisfied, it may be decided that this peak area is not the irregular reflection peak area.

84<the absolute value of the emitting angle of the peak area the absolute value of the emitting angle of the peak area<25 the sound volume level in the peak area<−15 dB

In this event, the above conditions (mathematical expressions) are given merely as examples, and numerical values used in the conditions may be changed appropriately. Also, any conditions explained above may be combined in use. In short, respective peak areas may be classified based on one or plural parameters of the emitting angles, the path distances, and the sound volume levels corresponding to respective peak areas.

(5) In the above embodiment, the case where the speaker units 153 are arranged in a matrix fashion is explained. In this case, any arranging mode may be employed if at least the portions that are aligned like a line is contained.

(6) In the above embodiment, the threshold value applied to the square value of the impulse response in specifying a plurality of peak areas from the level distribution chart (step SA100) may be changed appropriately. For example, the threshold value may be decreased when only the peak areas in a predetermined number (e.g., below five) or less are specified in step SA100 or the threshold value may be increased when the peak areas in excess of a predetermined number (e.g., eight or more) is specified, so that a particular efficiency and an accuracy in the peak areas of respective channels can be improved in subsequent steps SA110 and SA120.

(7) The program executed by the controlling portion 10 in the above embodiment may be provided in a state that this program is recorded in the magnetic recording medium (magnetic tape, magnetic disk (HDD, FD), or the like), the optical recording medium (optical disk (CD, DVD), or the like), the computer-readable recording medium such as magneto-optic recording medium, semiconductor memory, or the like. Also, the program may be downloaded via the network such as the Internet, or the like.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2008-046311 filed on Feb. 27, 2008, the contents of which are incorporated herein for reference.

What is claimed is:

1. A surround sound outputting device comprising:

a receiving portion which receives signals on a plurality of channels;

a storing portion which stores measuring sound data representing a sound;

an outputting portion which outputs a sound produced based on the signals on the plurality of channels or the measuring sound data in a controlled direction and in a beam shape;

a controlling portion which controls a direction of the sound output from the outputting portion;

a sound collecting portion which picks up the sound output from the outputting portion to produce picked-up sound data representing the picked-up sound;

an impulse response specifying portion which specifies impulse responses in respective directions from respective sound data produced by the sound collecting portion when the sound collecting portion picks up the sounds output from the outputting portion in the respective directions;

a path characteristic specifying portion which specifies path distances of the paths through which the sounds output in the respective directions arrive at the sound collecting portion from the outputting portion and levels of the impulse responses based on the impulse responses in the respective directions; and an allocating portion which specifies directions satisfying a predetermined relationship between the path distances of the paths in the respective directions and the levels of the impulse responses with respect to the plurality of channels respectively, and allocates the signals on the plurality of channels to the specified directions, wherein the controlling portion controls the outputting portion so that respective sounds based on the signals on the plurality of channels are output in the directions specified by the allocating portion, wherein the allocating portion specifies a direction of the impulse response with respect to each of the plurality of channels and allocates the signals on the plurality of channels to the specified directions of the impulse responses, when the level of the impulse response in each of the plurality of channels specified by the impulse response specifying portion exceeds a predetermined threshold value, and wherein the allocating portion specifies the direction of the impulse response in a state where a result of comparing the path distance specified by the path characteristic specifying portion with a criterion value, which is obtained by dividing a predetermined value by a cosine of emitting angle on a direction of the impulse response or a difference between the path distance and the criterion value, satisfies a predetermined condition.

2. The surround sound outputting device according to claim 1, wherein the measuring sound data represents an impulse sound.

3. The surround sound outputting device according to claim 1, wherein the impulse response specifying portion specifies the impulse responses by calculating a cross correlation between the picked-up sound data and the measuring sound data.

4. The surround sound outputting device according to claim 1, wherein the measuring sound data represents a white noise.

5. The surround sound outputting device according to claim 1, wherein the path characteristic specifying portion specifies the path distances based on leading timings in the impulse responses in the respective directions.

6. A surround sound outputting method for a surround sound outputting device having an outputting portion, a sound collecting portion, and a storing portion storing measuring sound data representing a sound, the method comprising:

an outputting step of outputting a sound with the outputting portion in a controlled direction and in a beam shape, based on signals on a plurality of channels or the measuring sound data stored in the storing portion;

a direction controlling step of controlling a direction of the sound output from the outputting portion;

a sound pick up step of picking up the sound output from the outputting portion with the sound collecting portion to produce picked-up sound data representing the picked-up sound;

an impulse response specifying step of specifying impulse responses in respective directions from respective sound data produced by the sound collecting portion when the sound collecting portion picks up the sounds output from the outputting portion in the respective directions;

a path distance specifying step of specifying path distances of the paths through which the sounds output in the respective directions arrive at the sound collecting portion from the outputting portion and levels of the impulse responses based on the impulse responses in the respective directions; and an allocating step of specifying directions satisfying a predetermined relationship between the path distances of the paths in the respective directions and the levels of the impulse responses with respect to the plurality of channels respectively, and allocating the signals on the plurality of channels to the specified directions, wherein the outputting portion outputs respective sounds based on the signals on the plurality of channels in the directions specified in the allocating step, wherein the allocating step specifies a direction of the impulse response with respect to each of the plurality of channels and allocates the signals on the plurality of channels to the specified directions of the impulse responses when the level of the impulse response in each of the plurality of channels specified in the impulse response specifying step exceeds a predetermined threshold value, and wherein the allocating step specifies the direction of the impulse response in a state where a result of comparing the path distance specified by the path characteristic specifying portion with a criterion value, which is obtained by dividing a predetermined value by a cosine of emitting angle on a direction of the impulse response or a difference between the path distance and the criterion value, satisfies a predetermined condition.

7. The method according to claim 6, wherein the measuring sound data represents an impulse sound.

8. The method according to claim 6, wherein the impulse responses are specified by calculating a cross correlation between the picked up sound data and the measuring sound data.

9. The method according to claim 6, wherein the measuring sound data represents a white noise.

10. The method according to claim 6, wherein the path distances are specified based on leading timings in the impulse responses in the respective directions.

11. The method according to claim 6, wherein the allocating step:

specifies a number of the impulse responses whose levels exceed a predetermined threshold value among the impulse responses specified in the impulse response specifying step;

changes the predetermined threshold value to a higher threshold value higher than the predetermined threshold value when the number of the impulse responses is smaller than a first predetermined number, and changes the predetermined threshold value to a lower threshold value lower than the predetermined threshold value when the number of the impulse responses is equal to or greater than a second predetermined number, which is greater than the first predetermined number; and specifies the direction of the impulse response with respect to each of the plurality of channels and allocates the signals on the plurality of channels to the specified directions when the number of the impulse responses is equal to or greater than the first predetermined number but smaller than the second predetermined number.

12. A surround sound outputting device comprising:

a receiving portion which receives signals on a plurality of channels;

a storing portion which stores measuring sound data representing a sound;

an outputting portion which outputs a sound produced based on the signals on the plurality of channels or the measuring sound data in a controlled direction and in a beam shape;

a controlling portion which controls a direction of the sound output from the outputting portion;

a sound collecting portion which picks up the sound output from the outputting portion to produce picked-up sound data representing the picked-up sound;

an impulse response specifying portion which specifies impulse responses in respective directions from respective sound data produced by the sound collecting portion when the sound collecting portion picks up the sounds output from the outputting portion in the respective directions;

a path characteristic specifying portion which specifies path distances of the paths through which the sounds output in the respective directions arrive at the sound collecting portion from the outputting portion and levels of the impulse responses based on the impulse responses in the respective directions; and an allocating portion which specifies directions satisfying a predetermined relationship between the path distances of the paths in the respective directions and the levels of the impulse responses with respect to the plurality of channels respectively, and allocates the signals on the plurality of channels to the specified directions, wherein the controlling portion controls the outputting portion so that respective sounds based on the signals on the plurality of channels are output in the directions specified by the allocating portion, wherein the allocating portion includes:

a number allocating portion which specifies a number of the impulse responses whose levels exceed a predetermined threshold value among the impulse responses specified by the path characteristic specifying portion; and a threshold value change portion which changes the predetermined threshold value to a higher threshold value higher than the predetermined threshold value when the number of the impulse responses specified by the number allocating portion is smaller than a first predetermined number, and changes the predetermined threshold value to a lower threshold value lower than the predetermined threshold value when the number of the impulse responses specified by the number allocating portion is equal to or greater than a second predetermined number, which is greater than the first predetermined number, and wherein the allocating portion specifies the direction of the impulse response with respect to each of the plurality of channels and allocates the signals on the plurality of channels to the specified directions when the number of the impulse responses specified by the number allocating portion is equal to or greater than the first predetermined number but smaller than the second predetermined number.

* * * * *